US010557674B1

(12) United States Patent
Mantas

(10) Patent No.: US 10,557,674 B1
(45) Date of Patent: Feb. 11, 2020

(54) BUFFER ASSEMBLY FOR FIREARMS

(71) Applicant: Dimitrios Mantas, Athens (GR)

(72) Inventor: Dimitrios Mantas, Athens (GR)

( * ) Notice: Subject to any disclaimer, the term of this patent is extended or adjusted under 35 U.S.C. 154(b) by 0 days.

(21) Appl. No.: 16/157,364

(22) Filed: Oct. 11, 2018

(51) Int. Cl.
*F41A 3/84* (2006.01)

(52) U.S. Cl.
CPC ..... *F41A 3/84* (2013.01)

(58) Field of Classification Search
CPC ..... F41A 3/78; F41A 3/80; F41A 3/82; F41A 3/84; F41A 3/90; F41A 3/94; F41A 3/68; F41C 23/00; F41C 23/06; F41C 23/08
See application file for complete search history.

(56) References Cited

U.S. PATENT DOCUMENTS 1,019,937 A * 3/1912 Whittier ..... F41A 19/31 42/16
1,360,873 A * 11/1920 Nils ..... F41A 3/26 42/25
1,367,354 A * 2/1921 Craig ..... F41C 23/06 89/198
1,457,961 A * 6/1923 Browning ..... F41A 3/56 42/16
1,788,279 A * 1/1931 Cutts ..... F41A 19/03 267/33
2,379,461 A * 7/1945 Simpson ..... F41A 19/03 42/70.06
2,426,661 A * 9/1947 Anderson ..... F16F 7/09 267/134
2,456,652 A * 12/1948 Simpson ..... F41A 3/78 89/198
2,504,958 A * 4/1950 Botts ..... F41A 25/14 89/198
2,779,249 A * 1/1957 Saetter-Lassen ..... F41A 3/84 89/198
2,788,714 A * 4/1957 Browning ..... F41A 25/12 89/177
2,791,945 A * 5/1957 Maier ..... F41A 3/78 89/198
2,831,404 A * 4/1958 Sampson ..... F41A 3/78 89/198
2,866,389 A * 12/1958 Simpson ..... F41A 3/78 29/463

(Continued)

OTHER PUBLICATIONS http://www.viceman.us/ViceMan_us/Downloads/CETME_Schematic.html; CETME Schematic View, Rifle Schematic, Sep. 27, 2018.

(Continued)

*Primary Examiner* — Derrick R Morgan
(74) *Attorney, Agent, or Firm* — Notaro, Michalos & Zaccaria P.C.

(57) ABSTRACT

A buffer assembly for a firearm with a frame containing a bolt that moves during a firing cycle, the assembly having a case containing a movable piston, a piston spring for biasing the piston forwardly, a spring flange engaged with the piston spring, an end cap for closing the case, one or more resilient washers between the spring flange and the end cap, and a buffer spring in the piston spring that is shorter than the piston spring, so that during a firing cycle, the bolt engage a contact end of the piston to move the piston rearwardly the piston spring to decelerate the bolt until the piston engages the buffer spring to further decelerate the bolt, the resilient washers compressing to contribute to the deceleration.

7 Claims, 7 Drawing Sheets

(56) References Cited

U.S. PATENT DOCUMENTS 2,900,877 A * 8/1959 McClenahan ..... F41A 3/46 42/16
2,973,694 A * 3/1961 Herlach ..... F41A 3/90 267/64.23
3,082,667 A * 3/1963 Ramseyer ..... F41A 11/00 89/198
3,251,270 A 5/1966 Seifried
3,371,442 A * 3/1968 Carlson ..... F41C 23/06 188/268
3,517,586 A * 6/1970 Stoner ..... F41A 3/78 89/198
3,603,577 A * 9/1971 DeRaad ..... F16F 7/06 267/151
4,028,993 A * 6/1977 Reynolds ..... F41A 3/78 89/130
4,057,003 A * 11/1977 Atchisson ..... F41A 3/26 89/138
4,150,819 A * 4/1979 Taylor ..... F41A 25/02 188/268
4,307,653 A 12/1981 Goes et al.
4,439,943 A * 4/1984 Brakhage ..... F41C 23/06 42/74
4,558,628 A * 12/1985 Bosshard ..... F41A 3/94 188/268
4,000,217 A * 2/1987 Jorczak
4,667,566 A * 5/1987 Bosshard ..... F41A 25/12 89/177
4,677,897 A * 7/1987 Barrett ..... F41A 3/26 89/148
5,279,202 A * 1/1994 Bellardi ..... F41A 3/82 89/130
5,392,553 A * 2/1995 Carey ..... F41C 23/14 42/73
5,513,730 A * 5/1996 Petrovich ..... F16F 9/3405 188/129
6,758,126 B1 * 7/2004 Houtsma ..... F41A 3/94 42/1.06
6,829,974 B1 * 12/2004 Gwinn, Jr. ..... F41A 3/70 89/130
7,124,529 B1 * 10/2006 Havelka, Jr. ..... F41C 23/08 42/74
7,131,367 B1 * 11/2006 Boerschig ..... F41A 3/94 89/198
7,478,495 B1 * 1/2009 Alzamora ..... F41C 23/06 42/74
7,793,453 B1 * 9/2010 Sewell, Jr. ..... F41C 23/14 42/73
8,210,090 B2 * 7/2012 Brown ..... F41A 29/00 89/193
8,430,015 B2 * 4/2013 Faifer ..... F41A 3/82 42/73
8,757,338 B2 * 6/2014 Miyasato ..... F16F 9/003 188/322.19
8,997,954 B2 * 4/2015 Rodenbeck ..... B60G 17/08 188/316
9,080,823 B1 * 7/2015 Mantas ..... F41A 25/12
9,341,437 B1 * 5/2016 Huang ..... F41A 3/84
9,347,738 B1 * 5/2016 Schumacher ..... F41A 11/04
9,739,566 B2 * 8/2017 Huang ..... F41C 23/06
9,915,492 B2 * 3/2018 Huang ..... F41C 23/06
9,921,013 B1 * 3/2018 Oglesby ..... F41A 3/80
9,970,722 B1 * 5/2018 Babb ..... F41A 3/82
10,006,739 B2 * 6/2018 Pollutro ..... F41C 23/06
10,054,378 B2 * 8/2018 Pawlowski ..... F41A 3/84
2002/0053156 A1 * 5/2002 McCarthy ..... F41C 23/06 42/74
2003/0154640 A1 * 8/2003 Bragg ..... F41C 23/08 42/74
2004/0103777 A1 * 6/2004 Moore ..... F41A 3/22 89/130
2005/0246931 A1 * 11/2005 Poff, Jr. ..... F41C 23/06 42/1.06
2006/0236853 A1 * 10/2006 Boersching ..... F41A 3/94 89/198
2008/0110074 A1 * 5/2008 Bucholtz ..... F41C 23/06 42/1.06
2008/0178508 A1 * 7/2008 Cinciu ..... F41C 23/06 42/1.06
2009/0001636 A1 * 1/2009 Miyasato ..... F16F 9/19 267/64.13
2009/0095584 A1 * 4/2009 Kondo ..... B60G 11/15 188/267
2010/0050492 A1 * 3/2010 Faifer ..... F41A 3/82 42/1.06
2010/0071246 A1 * 3/2010 Vesligai ..... F41C 23/04 42/75.03
2010/0122482 A1 * 5/2010 Simms ..... F41C 23/08 42/1.06
2010/0140031 A1 * 6/2010 Miyasato ..... F16F 9/003 188/280
2010/0281727 A1 * 11/2010 Quaedpeerds ..... F41C 23/06 42/1.06
2011/0101585 A1 * 5/2011 Kamae ..... F16F 9/3242 267/226
2011/0138668 A1 * 6/2011 Thomas ..... F41C 23/06 42/1.06
2011/0179687 A1 * 7/2011 Caravaggi ..... F41A 3/94 42/1.06
2012/0297656 A1 * 11/2012 Langevin ..... F41A 3/66 42/16
2013/0319217 A1 * 12/2013 Gangl ..... F41A 3/84 89/198
2014/0059909 A1 * 3/2014 Caudle ..... F41A 3/84 42/1.06
2014/0075798 A1 * 3/2014 Kincel ..... F41A 3/84 42/1.06
2016/0010944 A1 * 1/2016 Downey ..... F41C 23/06 42/74
2017/0067716 A1 * 3/2017 Huang ..... F41C 23/06
2017/0130799 A1 * 5/2017 Spyche, Jr. ..... F16F 13/007
2017/0205164 A1 * 7/2017 Cassels ..... F41A 3/84
2017/0299295 A1 * 10/2017 Pawlowski ..... F41A 3/84
2017/0314886 A1 * 11/2017 Huang ..... F41C 23/06
2018/0010870 A1 * 1/2018 Mantas ..... F41A 3/86
2018/0224227 A1 * 8/2018 Durham, III ..... F41A 3/26

OTHER PUBLICATIONS https://www.bevfitchett.us/hk-g3-caliber-7-62-10-51-nato/info-ysw.html; 3 Assault Rifle Blueprints—HK G3 Caliber 7.62 x 51 Nato; Bev Fitchett's Guns Magazine » HK G3 Caliber 7.62 x 51 Nato, G3 Assault Rifle Blueprints, Sep. 27, 2018.

* cited by examiner

BUFFER ASSEMBLY FOR FIREARMS

FIELD AND BACKGROUND OF THE INVENTION

The present invention relates generally to the field of firearms, and in particular to a new and useful buffer assembly in or near the stock of a rifle or carbine for absorbing some of the force of a rearwardly moving bolt as it reaches its rearmost position during a firing cycle.

Buffer assemblies in or near the stock of a rifle or carbine are known. Their purpose is to absorb some of the rearward shock or impulse force that occurs when the bolt of a rifle or carbine reaches its rearmost position during a firing cycle.

An example of such a buffer assembly is found in the forward end of the stock of the Heckler & Koch GmbH (H&K) model G3, a 7.62×51 mm NATO, select-fire battle rifle. This buffer assembly includes a housing that contains a single, heavy biased (i.e. stiff), metal coil spring having a few of its coils wrapped by a copper ribbon coil that further reduces the resiliency of its biasing effect.

A need exists for an improved buffer assembly that better absorbs the impulse force of a rearwardly moving bolt as it strikes the stock area of a rifle or carbine.

SUMMARY OF THE INVENTION

It is therefore an object of the present invention to provide an improved buffer assembly in or near the stock of a firearm that better absorbs and attenuates the rearward impulse force experience at the stock of the firearm, by the rearwardly moving bolt as it strikes the buffer assembly at its rearward most position during a firing cycle.

Accordingly, a further object of the invention is to provide a buffer assembly for a firearm having frame containing a bolt that moves rearwardly toward a rearmost position during a firing cycle, and a stock at the rear of the frame, the buffer assembly comprising a case, a piston mounted for forward and rearward movement in the case, the piston having forward rest position and including a contact end that extends forwardly of the case when the piston is in the rest position, a piston spring having a forward end engaged with the piston in the case, for biasing the piston toward the rest position, the piston spring being a coil spring, a spring flange engaged with a rearward end of the piston spring and mounted for movement in the case, an end cap connected to the case for closing a rearward end of the case, at least one resilient washer in the case, between the spring flange and the end cap, and a buffer spring in the piston spring, the buffer spring being shorter than the piston spring, whereby, during a firing cycle, the bolt is adapted to engage the contact end of the piston to move the piston rearwardly in the case against a compression of the piston spring to decelerate a rearward motion of the bolt until the piston engages the buffer spring which compresses to further decelerate the rearward motion of the bolt, the at least one resilient washer also compressing to contribute to the deceleration of the bolt.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
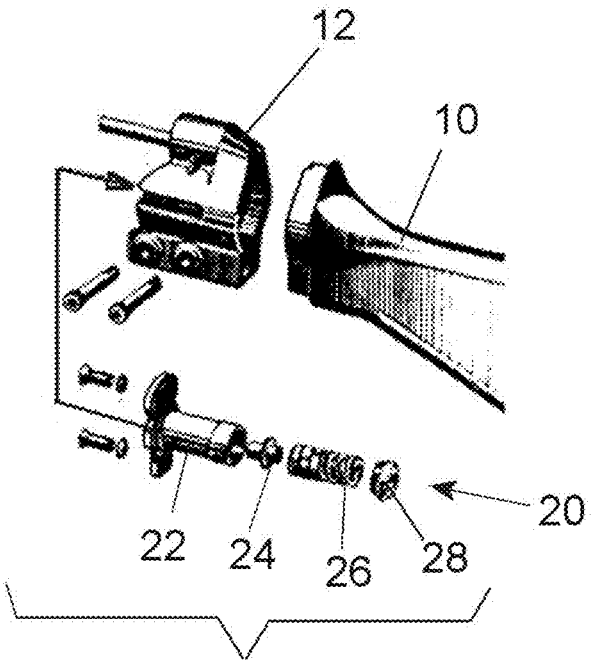
FIG. 1 (PRIOR ART)
FIG. 1 is a fragmentary, exploded view of the prior art buffer assembly of an H&K model G3 rifle, with some surrounding parts of the rifle also shown.
Figure 2:
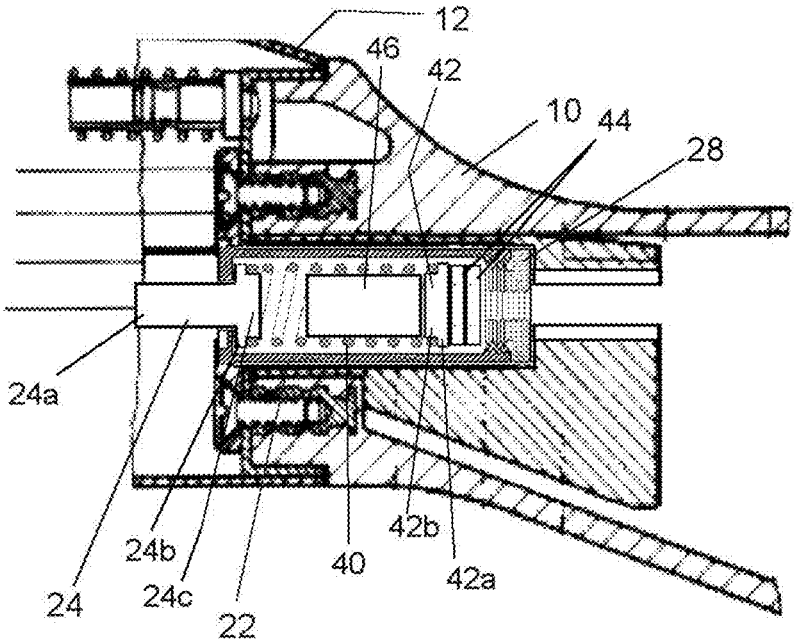
FIG. 2 is a sectional view of the buffer assembly of the invention, installed in the same rifle type and in a rest position.

Referring now to the drawings, in which like reference numerals are used to refer to the same or similar elements, FIG. 1 shows the known buffer assembly 20 and parts of an H&K model G3 rifle that includes a frame with a back plate 12 and a stock 10 to be connected to the back plate by a pair to pins shown in the drawing. For the purpose of this disclosure, the term "stock" is used to include any other structures at the rear end of the firearm, such as collapsible stocks or handles for compact or other versions of a firearm that utilized a buffer assembly. Also, although reference is here made to a "bolt," this structure is sometimes called a bolt carrier. The term "bolt" is here meant to include all such rearwardly moving structures during a firing cycle.

The known buffer assembly 20 functions for a firearm having frame containing a bolt that moves rearwardly toward a rearmost position during a firing cycle, and a stock at the rear of the frame. The known buffer assembly of FIG. 1 comprises a case 22, a piston 24 mounted for forward and rearward movement in the case 22, the piston having forward rest position and including a contact end **24*a* that extends forwardly of the case when the piston is in the rest position, and a strong metal coil piston spring 26 compressed between the piston 24 and an end cap 28 that is screwed to the case 22** for closing a rear end of the case. The known buffer assembly also includes a copper ribbon wound around a few coils of the piston spring, to modify the biasing effect of the spring in some manner. Since copper is a malleably metal, this extra coil of ribbon does not appear to add any biasing effect and cannot be called a spring.

Referring now to FIGS. 2 to 6, the buffer assembly of the invention is also for a firearm having frame containing a bolt 30 that moves rearwardly toward a rearmost position during a firing cycle, and a stock 10 at the rear of the frame. The buffer assembly of the invention, however, replaces the single heavy spring of the prior art with a combination of elements that has been found to greatly soften the impulse force and shock of the known assembly, by spreading out the deceleration of the bolt as it reaches it rearward most travel during a firing cycle.

To this end, the buffer assembly of the invention comprises a case 22, a piston 24 mounted for forward and rearward movement in the case 22, the piston having forward rest position and including a contact end 24*a* that extends forwardly of the case through an opening at the front of the case, when the piston is in its toward rest position.

A piston spring 40 of the assembly has a forward end engaged onto a smaller diameter rear seat 24*c* of the piston 24 and against a piston flange 24*b* thereof, in the case 22. Spring 40 biases the piston 24 toward the forward rest position of FIGS. 2 and 3. The piston spring 40 is advantageously a metal coil spring but other springs may be usable.

A spring flange 42 is engaged with a rearward end of the piston spring 40 and mounted for movement in the case 22. An end cap 28 is connected, e.g. by being treaded into the rear open end of the case 22 for closing a rearward end of the case.

At least one, but preferably two resilient washers 44 are provided in the case 22, and are placed between the spring flange 42 and the end cap 28, and a buffer spring 46 is provided in the coils of the piston spring 40, the buffer spring 46 being shorter than the piston spring 40.

The spring flange 42 includes a flange portion 42*a* for moving in the case 22 and against which the reare end of the piston spring 40 engages, and a smaller diameter seat 42*b* for engaging in the rearward end of the piston spring 40.

Figure 3:
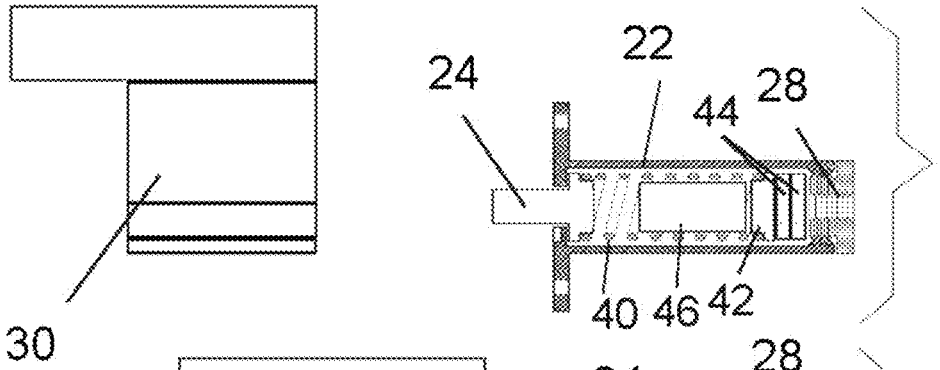
FIG. 3 is a sectional view of the buffer assembly of the invention in the rest position with the rear end of the rifle bolt, also in a rest position before the start of a firing cycle.
Figure 4:
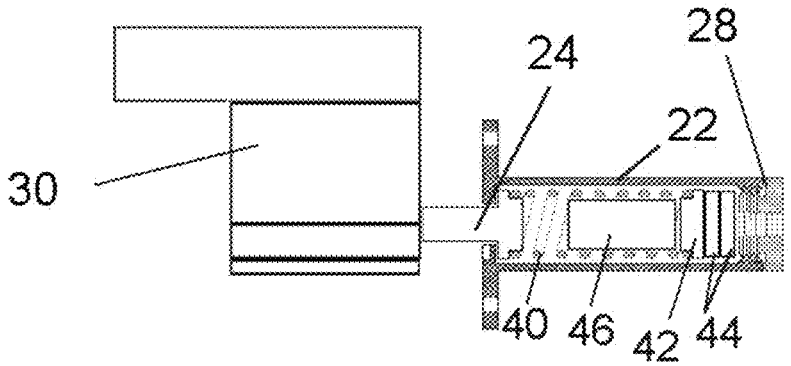
FIG. 4 is a view similar to FIG. 3, during an intermediate time of the firing cycle, when the rear face of the bolt has first made contact with a contact end of a buffer piston of the buffer assembly.
Figure 5:
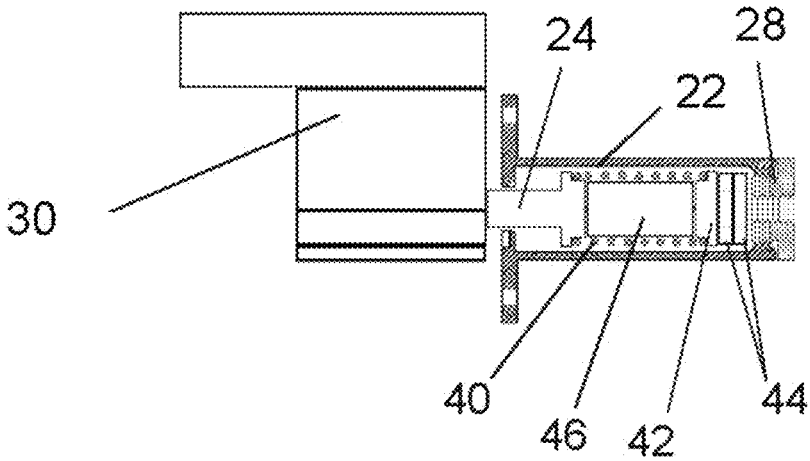
FIG. 5 is a view similar to FIG. 3, during a later intermediate time of the firing cycle, when the rear face of the bolt has moved to its rearmost position of the firing cycle, to compress all biasing parts of the buffer assembly of the invention to their maximum effect.
Figure 6:
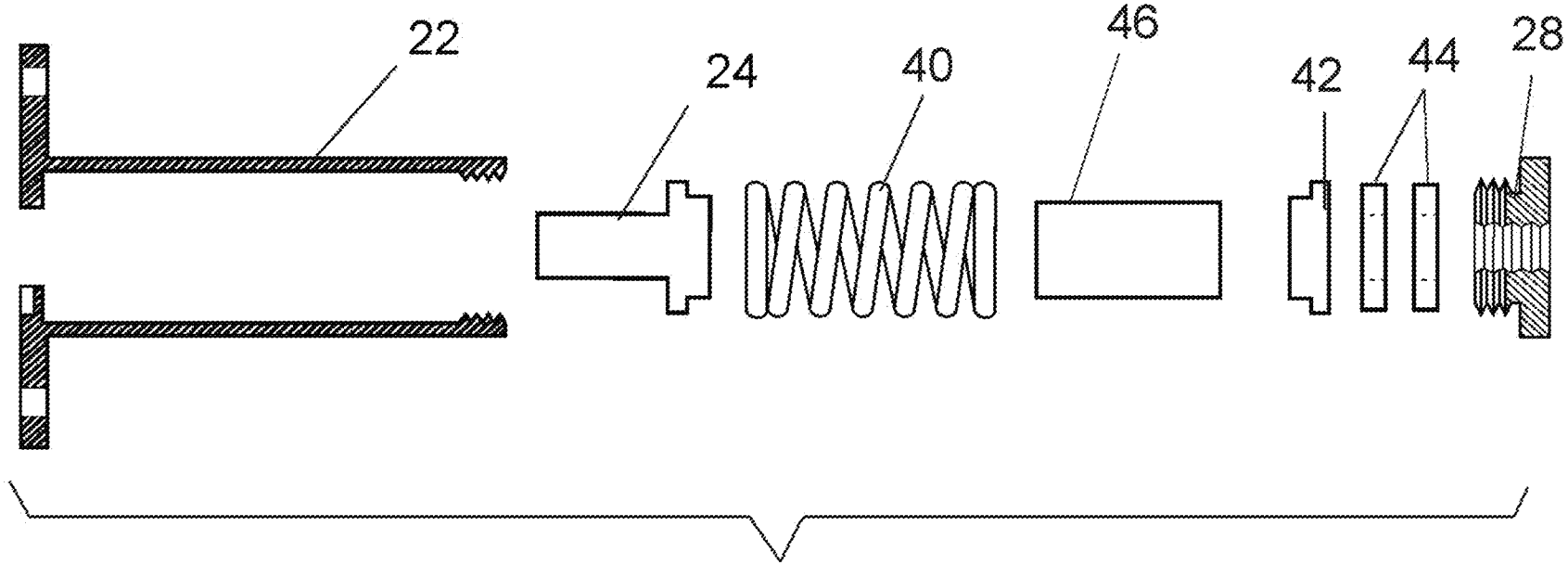
FIG. 6 is an explode view of a first embodiment of the invention, partially in section.
Figure 7:
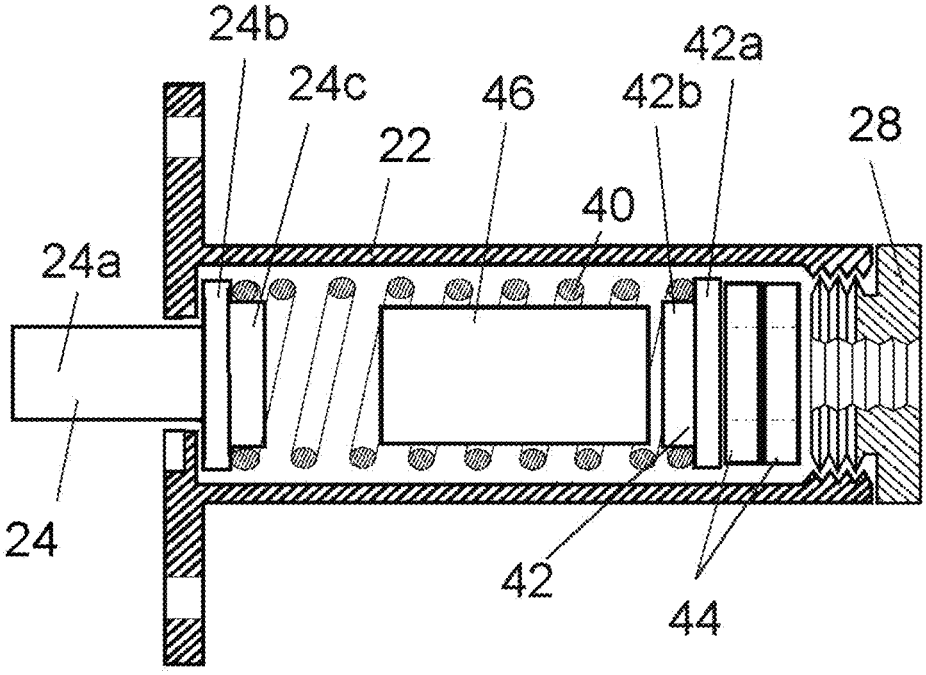
FIG. 7 is a sectional view, partly in side elevation, of the first embodiment, in a rest position.
Figure 8:
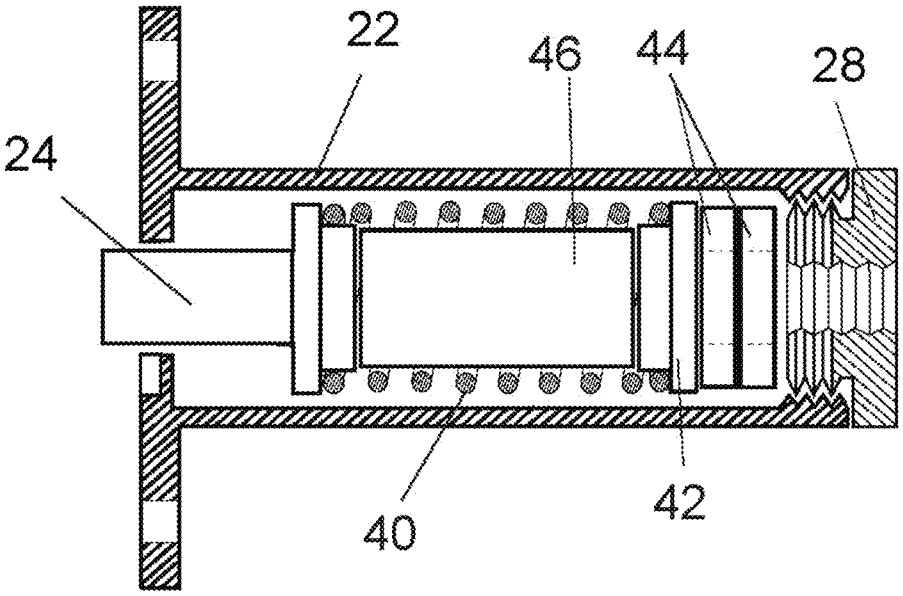
FIG. 8 is a sectional view, partly in side elevation, of the first embodiment, in a position of maximum compression when the bolt (not shown in FIG. 8) has reached its rearward most position during a firing cycle.

During a firing cycle, the bolt 30 is adapted to engage the contact end 24*a* of the piston 24 to move the piston rearwardly in the case 22 against the compression of the piston spring 40 to decelerate the rearward motion of the bolt until the piston 24 engages the buffer spring 46 which compresses to further decelerate the rearward motion of the bolt, the resilient washers 44 also compressing to contribute to the deceleration of the bolt. This sequence is shown in FIGS. 3, 4 and 5.

In the first embodiment of the invention shown in FIGS. 2 to 8, the buffer spring 46 is a cylinder of resilient material, preferably rubber.

Figure 9:
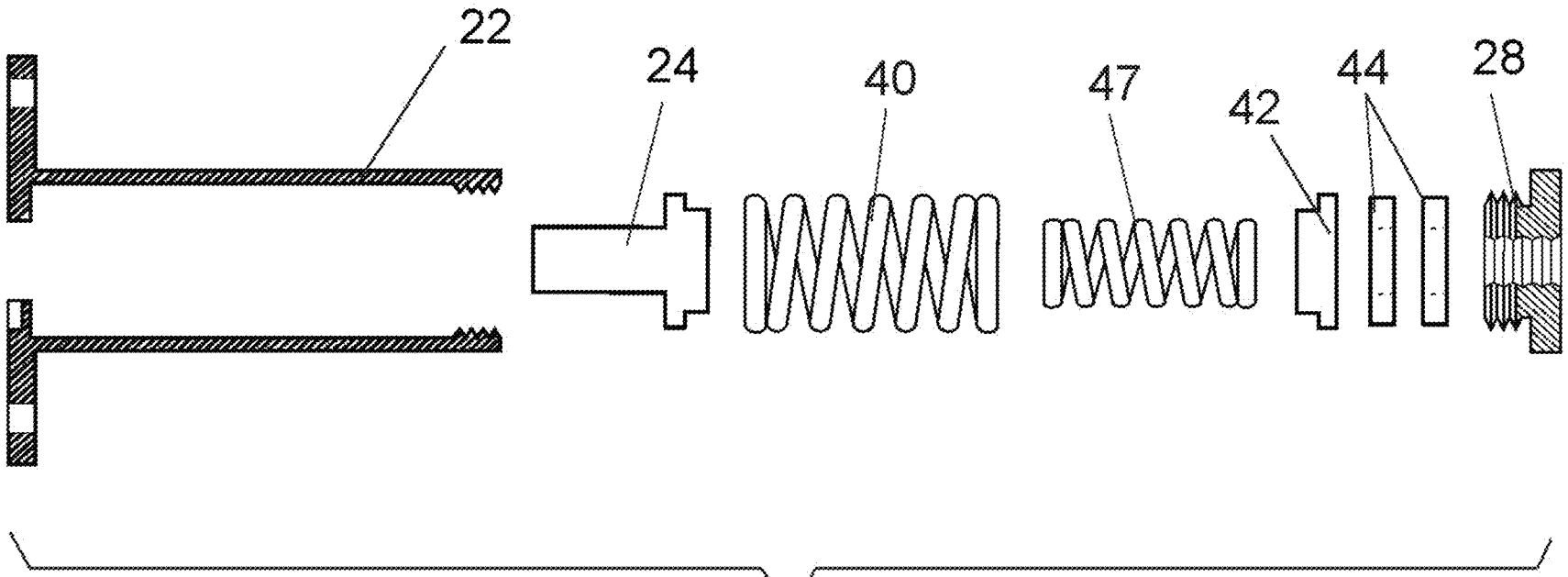
FIG. 9 is an explode view of a second embodiment of the invention, partially in section.
Figure 10:
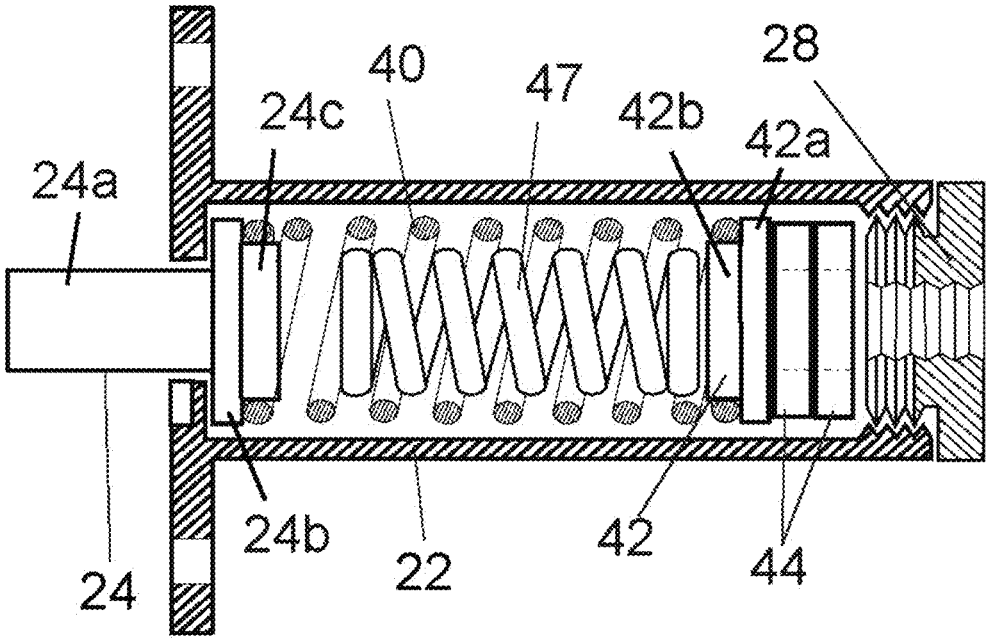
FIG. 10 is a sectional view, partly in side elevation, of the first embodiment, in a rest position.
Figure 11:
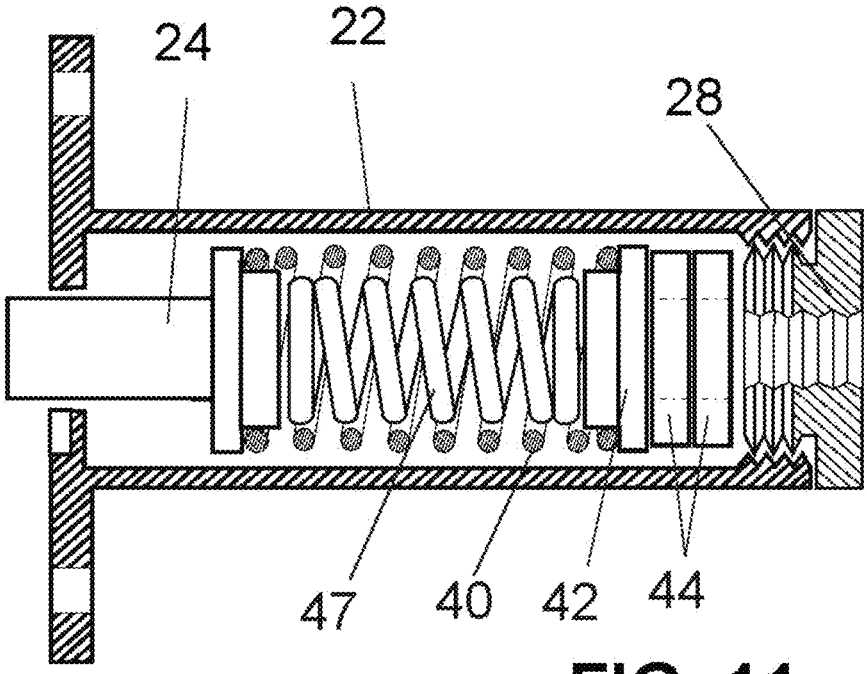
FIG. 11 is a sectional view, partly in side elevation, of the first embodiment, in a position of maximum compression when the bolt (not shown in FIG. 8) has reached its rearward most position during a firing cycle.

In the second embodiment illustrated in FIGS. 9 to 11, the buffer spring 47 is a coil spring, preferably made of spring steel like the piston spring 40.

In both embodiments the buffer spring 46 or 47 is from about 20 to 50 to percent shorter than the piston spring 40.

To keep the buffer spring 46 or 47 from moving in the piston spring 40 in the rest position, each has about the same outside diameter as the inside diameter of spring 40 so there is a slight friction fit between the inner buffer spring and the outer piston spring. This friction fit is released as soon as the piston spring 40 starts compressing under the influence of the rearward moving bolt 30, since this compression slightly increases the inside diameter of the spring 40. Once released, the now free moving inner and shorter buffer spring 46 or 47 may add its additional and stages decelerating biasing effect on the rearward motion of the bolt as the bolt further moves the piston 24 rearwardly to also engage and compress the buffer spring, and also the resilient washers 44.

Figure 12:
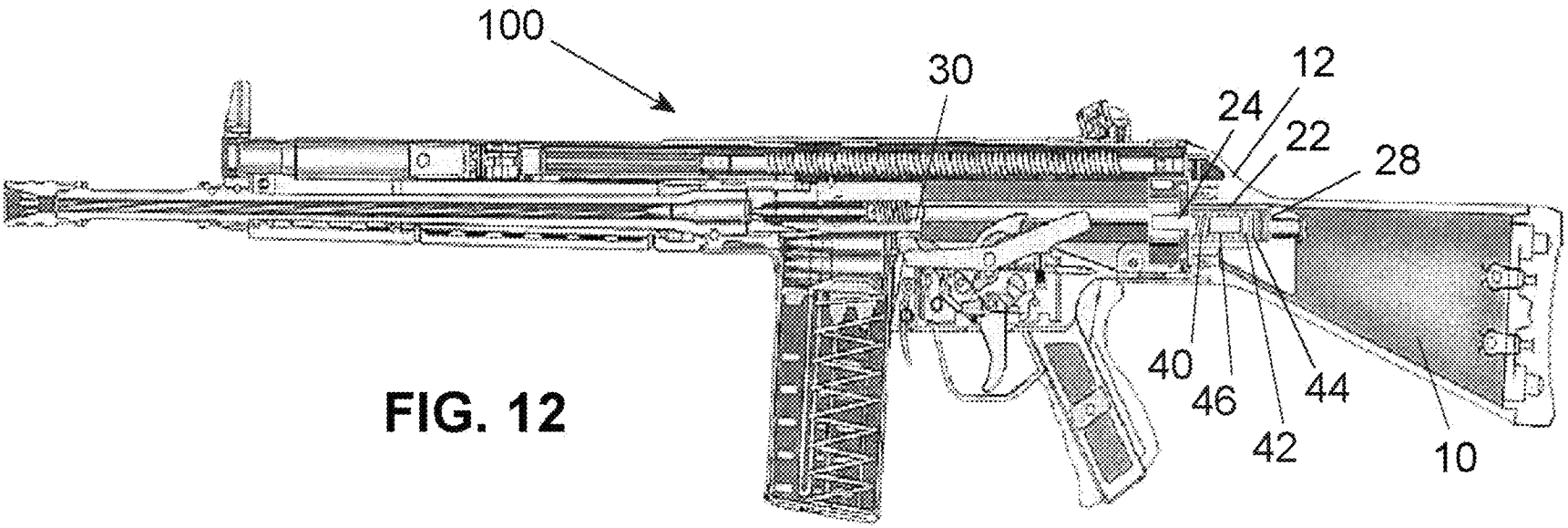
FIG. 12 is a side sectional view of an H&K model G3 rifle into which the buffer assembly of the invention has been installed.

FIG. 12 is a side sectional view of an H&K model G3 rifle 100 with frame and back plate 12 for bolt 30 and stock 10, into which the buffer assembly of the invention has been installed.

In other embodiments of the invention the shorter buffer spring my be a larger diameter coils spring that is outside the longer piston spring or other combinations may be provided as long as the two springs act in two stages and are effective parallel to each other, against the rearward movement of the bolt.

While specific embodiments of the invention have been shown and described in detail to illustrate the application of the principles of the invention, it will be understood that the invention may be embodied otherwise without departing from such principles.

What is claimed is:

1. In a firearm (100) of the H&K model G3 type having a frame containing a bolt (30) that moves rearwardly toward a rearmost position against a restoring force of a recoil spring during a firing cycle, and a stock at the rear of the frame that is spaced from the recoil spring, the improvement comprising a buffer assembly substantially in the stock, the buffer assembly consisting essentially of:

a case (22);

a piston (24) mounted for forward and rearward movement in the case (22), the piston having forward rest position and including a contact end (24*a*) that extends forwardly of the case when the piston is in the rest position;

a piston spring (40) having a forward end engaged with the piston (24) in the case (22), for biasing the piston toward the rest position, the piston spring being a coil spring;

a spring flange (42) engaged with a rearward end of the piston spring (40) and mounted for movement in the case (22);

an end cap (28) connected to the case (22) for closing a rearward end of the case;

at least one resilient washer (44) in the case (22), between the spring flange (42) and the end cap (28); and a buffer spring (46) in the piston spring (40), the buffer spring (46) being shorter than the piston spring (40) and being a cylinder of resilient material (46);

whereby, during a firing cycle, the bolt (30) is adapted to engage the contact end (24*a*) of the piston (24) to move the piston rearwardly in the case (22) against a compression of the piston spring (40) to decelerate a rearward motion of the bolt until the piston (24) engages the buffer spring (46) which compresses to further decelerate the rearward motion of the bolt, the at least one resilient washer (44) also compressing to contribute to the deceleration of the bolt.

2. The buffer assembly of claim 1, wherein the buffer spring is made of rubber (46).

3. The buffer assembly of claim 1, including a plurality of resilient washers (44).

4. The buffer assembly of claim 1, wherein the piston (24) includes a flange portion (24*b*) with a seat (24*c*) for engaging in the forward end of the piston spring (40).

5. The buffer assembly of claim 1, wherein the spring flange (42) includes a flange portion (42*a*) for moving in the case (22) and a seat (42*b*) for engaging in the rearward end of the piston spring (40).

6. The buffer assembly of claim 1, wherein the piston (24) includes a flange portion (24*b*) with a seat (24*c*) for engaging in the forward end of the piston spring (40), the spring flange (42) including a flange portion (42*a*) for moving in the case (22) and a seat (42*b*) for engaging in the rearward end of the piston spring (40).

7. The buffer assembly of claim 1, wherein the at least one resilient washer (44) is rubber.

* * * * *